US007730953B2

(12) United States Patent
Casciaro

(10) Patent No.: US 7,730,953 B2
(45) Date of Patent: Jun. 8, 2010

(54) MULTI-CYCLE SINGLE LINE SWITCH

(75) Inventor: Dario Casciaro, Abruzzo (IT)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/039,844

(22) Filed: Feb. 29, 2008

(65) Prior Publication Data

US 2009/0218102 A1 Sep. 3, 2009

(51) Int. Cl.
*E21B 43/00* (2006.01)

(52) U.S. Cl. ..... 166/321; 166/313; 166/319; 166/320

(58) Field of Classification Search ..... 166/313, 166/319, 320
See application file for complete search history.

(56) References Cited

U.S. PATENT DOCUMENTS

| | | | | |
|---|---|---|---|---|
| 6,352,119 | B1 * | 3/2002 | Patel | 166/386 |
| 6,948,561 | B2 | 9/2005 | Myron | 166/240 |
| 2002/0014338 | A1 * | 2/2002 | Purkis et al. | 166/375 |
| 2007/0163774 | A1 | 7/2007 | Hosatte et al. | 166/66.6 |
| 2009/0065218 | A1 * | 3/2009 | Loretz et al. | 166/375 |

* cited by examiner

*Primary Examiner*—William P Neuder
*Assistant Examiner*—Yong-Suk Ro
(74) *Attorney, Agent, or Firm*—Shawn Hunter

(57) ABSTRACT

Systems and methods for selectively operating multiple hydraulic pressure controlled devices (PCDs) within a borehole using a common inflow and outflow line and a common cycling line. A control system is used wherein each of the PCDs is operationally associated with a separate sleeve controller. The sleeve controller for each PCD controls whether the individual PCD can be actuated by hydraulic pressure variations in the common inflow and outflow lines.

18 Claims, 13 Drawing Sheets

MULTI-CYCLE SINGLE LINE SWITCH

BACKGROUND OF THE INVENTION

1. Field of the Invention

The invention relates generally to hydraulic switches used to control the actuation of multiple pressure controlled devices within a wellbore.

2. Description of the Related Art

It is common in downhole wellbore production systems to employ sliding sleeve valves, safety valve or chemical injection valves that use hydraulic pressure control for actuation. Each of these pressure controlled devices ("PCD"s) uses a pair of hydraulic control lines—an inflow line and an outflow line. In a number of instances, it is desired to have multiple PCDs within a borehole. Because each PCD uses two control lines, this means that a large number of control lines that must be run into the wellbore. The inventor has realized that there are a number of significant advantages to being able to reduce the number of control lines that are run into a wellbore. The reduction of control lines results in a direct reduction in cost due to the reduced amount of control line that must be run into the wellbore. In addition, there are indirect savings, particularly in deepwater wells, as there are fewer lines that require a dedicated feed through in the subsea tree and dedicated umbilicals back to the surface. Moreover, each additional control line that is used in a wellbore requires dedicated pressure testing and time. Further, a reduced number of control lines results in a more reliable system since the number of potential leak paths is reduced.

SUMMARY OF THE INVENTION

The present invention provides systems and methods for operating multiple hydraulic PCDs within a borehole using a common inflow and outflow line and a common cycling line. In preferred embodiments, the PCDs comprise sliding sleeve valve devices which are used to control flow of production fluid into the production string of a wellbore. In a preferred embodiment, a control system is used wherein each of the PCDs is operationally associated with a separate sleeve controller. The sleeve controller for each PCD controls whether the individual PCD can be actuated by hydraulic pressure variations in the common inflow and outflow lines.

In a currently preferred embodiment, each sleeve controller includes an outer housing that defines an interior chamber. A piston member is moveably disposed within the chamber. Movement of the piston member with respect to the surrounding chamber is controlled by a J-slot lug mechanism. The J-slot lug mechanism causes the piston member to be moved between a first position wherein the corresponding PCD can be actuated by the inflow/outflow lines and a second position wherein the corresponding PCD is unable to be actuated by the inflow/outflow lines. Movement of the piston member within the sleeve controller is preferably done by selective pressurization of the cycling line.

In operation, the control system can be operated in a stepwise manner to move the sleeve controllers for each PCD are moved sequentially through a series of positions which afford operational control of selected PCDs in accordance with a predetermined scheme.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
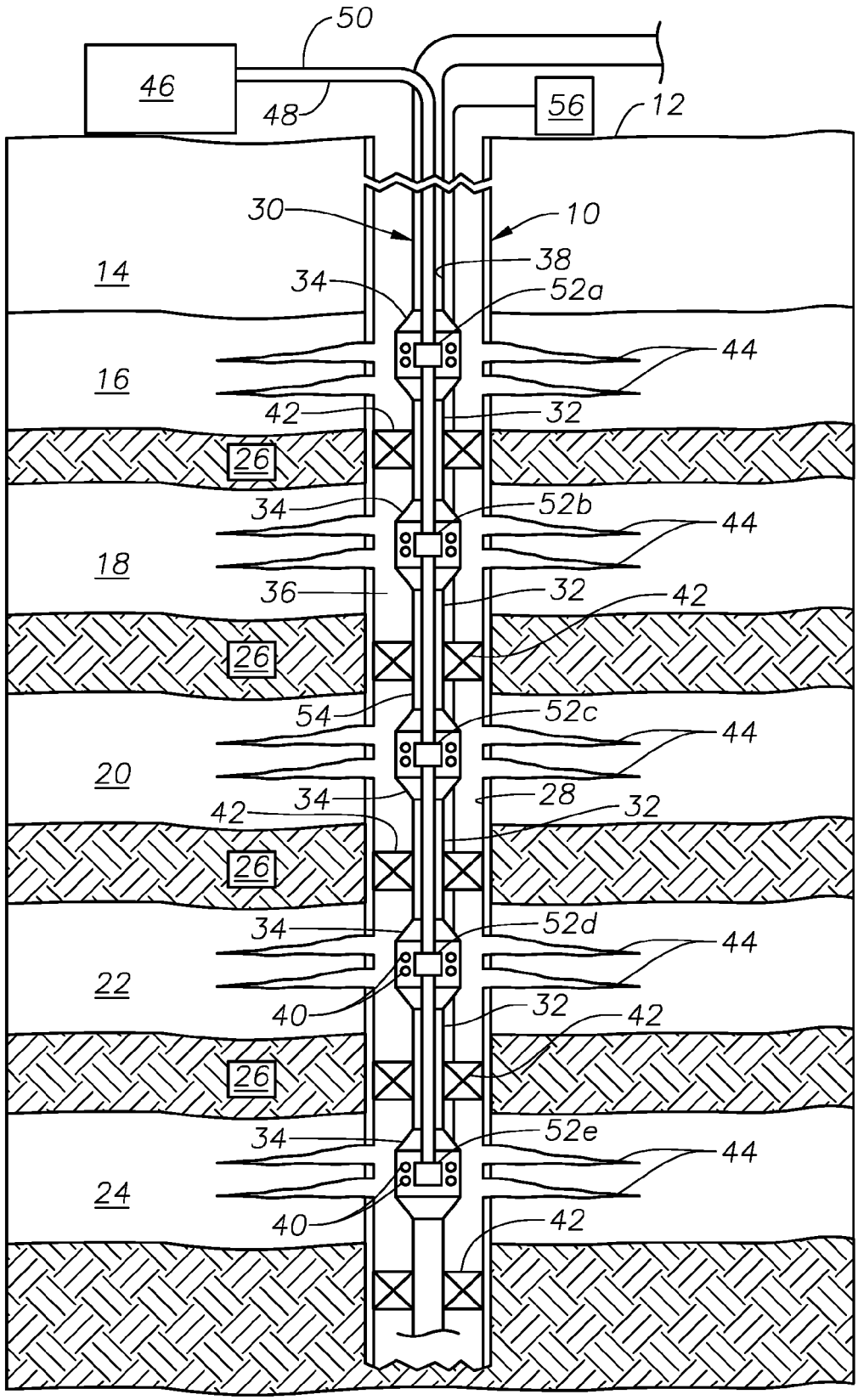
FIG. 1 is a side, cross-sectional view of an exemplary wellbore containing a production assembly which incorporates five production nipples which incorporate sliding sleeve devices.

FIG. 1 depicts an exemplary production wellbore 10 which has been drilled from the surface 12 downwardly through the earth 14. The wellbore 10 passes through five separate hydrocarbon-bearing production formations 16, 18, 20, 22 and 24 which are separated from each other by strata 26 of substantially fluid-impermeable rock. The wellbore 10 has been lined with metallic casing 28 in a manner known in the art.

A hydrocarbon production string 30 is disposed within the wellbore 10. The production string 30 is made up of sections 32 of standard production tubing and production nipples 34, which are used to receive production fluids from the surrounding annulus 36 and transmit them into the interior flowbore 38 of the production tubing string 30 via external openings 40. Fluid flow through the nipples 34 is selectively controlled by an interior sliding sleeve, in a manner which will be described shortly.

The production string 30 is disposed within the wellbore 10 until each of the production nipples 34 is generally aligned with one of the production formations 16, 18, 20, 22, 24. Packers 42 are set within the annulus 36 between each of the formations 16, 18, 20, 22, 24 in order to isolate the production nipples 34. Perforations 44 are disposed through the casing 28 and into each of the formations 16, 18, 20, 22, 24.

A hydraulic controller 46, of a type known in the art, is located at the surface 12. The controller 46 is a fluid pump which may be controlled manually or by means of a computer. Hydraulic control lines 48, 50 extend from the controller 46 into the wellbore 10. The control lines 48, 50 are interconnected with a series of sleeve controllers 52*a*, 52*b*, 52*c*, 52*d* and 52*e* which are operably associated with each of the production nipples 34 for selective operation of the sliding sleeves contained therein. A hydraulic cycling line 54 also extends from a surface-based pump 56 to each of the production nipples 34.

Figure 2:
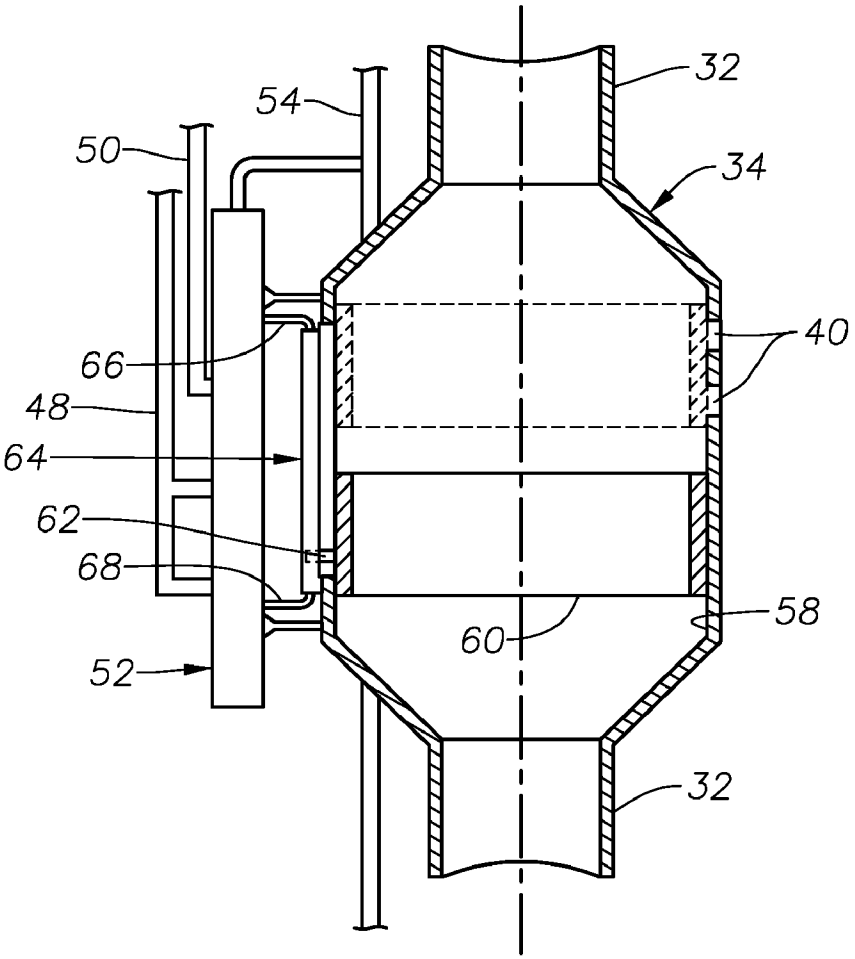
FIG. 2 is a side view, partially in cross-section, illustrating an exemplary pressure controlled sliding sleeve device used within the production assembly of FIG. 1.

FIG. 2 illustrates an exemplary production nipple 34 and sleeve controller 52 apart from the production string 30. As can be seen, the production nipple 34 includes an interior chamber 58 which has a sliding sleeve member 60 moveably disposed within. The sleeve member 60 is shown in a first position in FIG. 2, wherein the sleeve member 60 does not block the fluid openings 40. In this position, the production nipple 34 is "open" and allows production fluids within the annulus 36 to enter the chamber 58 for transport to the surface 12 via the string 30. The sleeve member 60 can be moved to a second position, shown in phantom lines as 60*a* in FIG. 2. In the second position, the sleeve member 60 blocks the fluid openings 40, and the production nipple 34 is considered to be "closed" such that production fluids in the annulus 36 cannot enter the chamber 58. A cantilever arm 62 is secured to the sleeve 60 and extends into hydraulic cylinder 64. An upper fluid conduit 66 extends from the upper end of the cylinder 64 to the sleeve controller 52 while a lower fluid conduit 68 extends from the lower end of the cylinder 64 to the sleeve controller 52. The sleeve controller 52 is operably interconnected with each of the control lines 48, 50 and the cycling line 54.

Figure 3:
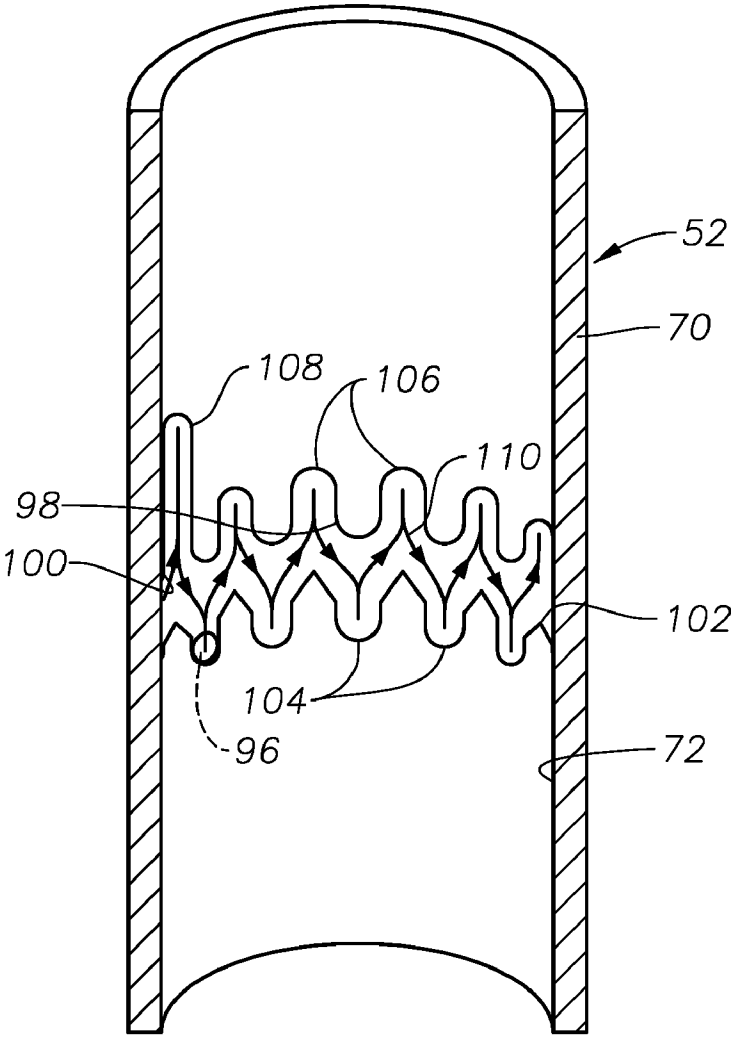
FIG. 3 is a cut-away view of a portion of the housing for a sleeve controller used in the present invention.
Figure 4:
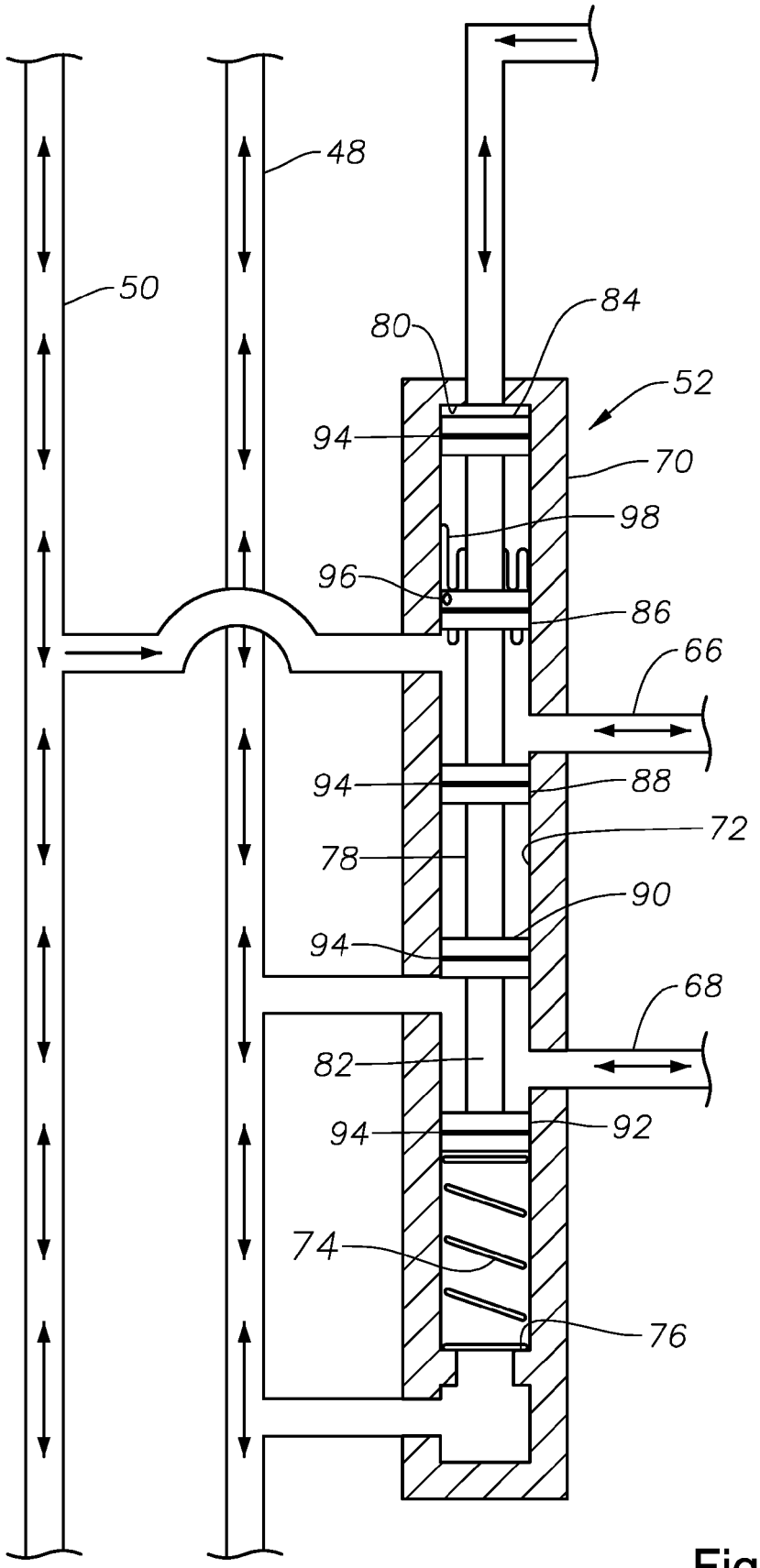
FIG. 4 is a side, cross-sectional view of an exemplary sleeve controller and associated components used within the present invention.

The structure and operation of the sleeve controllers 52 is better understood with further reference to FIGS. 3 and 4. Each of the sleeve controllers 52 includes an outer, generally cylindrical housing 70 that defines an interior piston chamber 72. The piston chamber 72 contains a compression spring 74 that is disposed upon inner flange 76. A piston member 78 is moveably disposed within the chamber 72 and urged toward the upper end 80 of the chamber 72 by spring 74. In the depicted embodiment, the piston member 78 includes a central shaft 82 which carries five radially-enlarged piston portions 84, 86, 88, 90 and 92 which are fixedly secured upon the shaft 82. Each of these radially-enlarged portions carries an annular elastomeric seal 94 which forms a fluid seal against the surrounding housing 70.

One of the enlarged portions, 86, carries a radially-outwardly extending lug member 96. The lug member 96 resides within a lug path 98, which is depicted as being inscribed in the interior wall of the housing 70. Although FIG. 4 depicts the lug path 98 as being actually inscribed on the interior wall of the housing, this is merely schematic. In actuality, the path 98 may be inscribed in a housing portion that is diametrically larger than the actual seal bore of the housing 70 or in an associated cylinder that is separate from the housing 70. FIG. 3 depicts an exemplary lug path in greater detail. During operation, the lug member 96 (shown in phantom lines in FIG. 3) is restrained to move within the lug path 98.

Figure 5A:
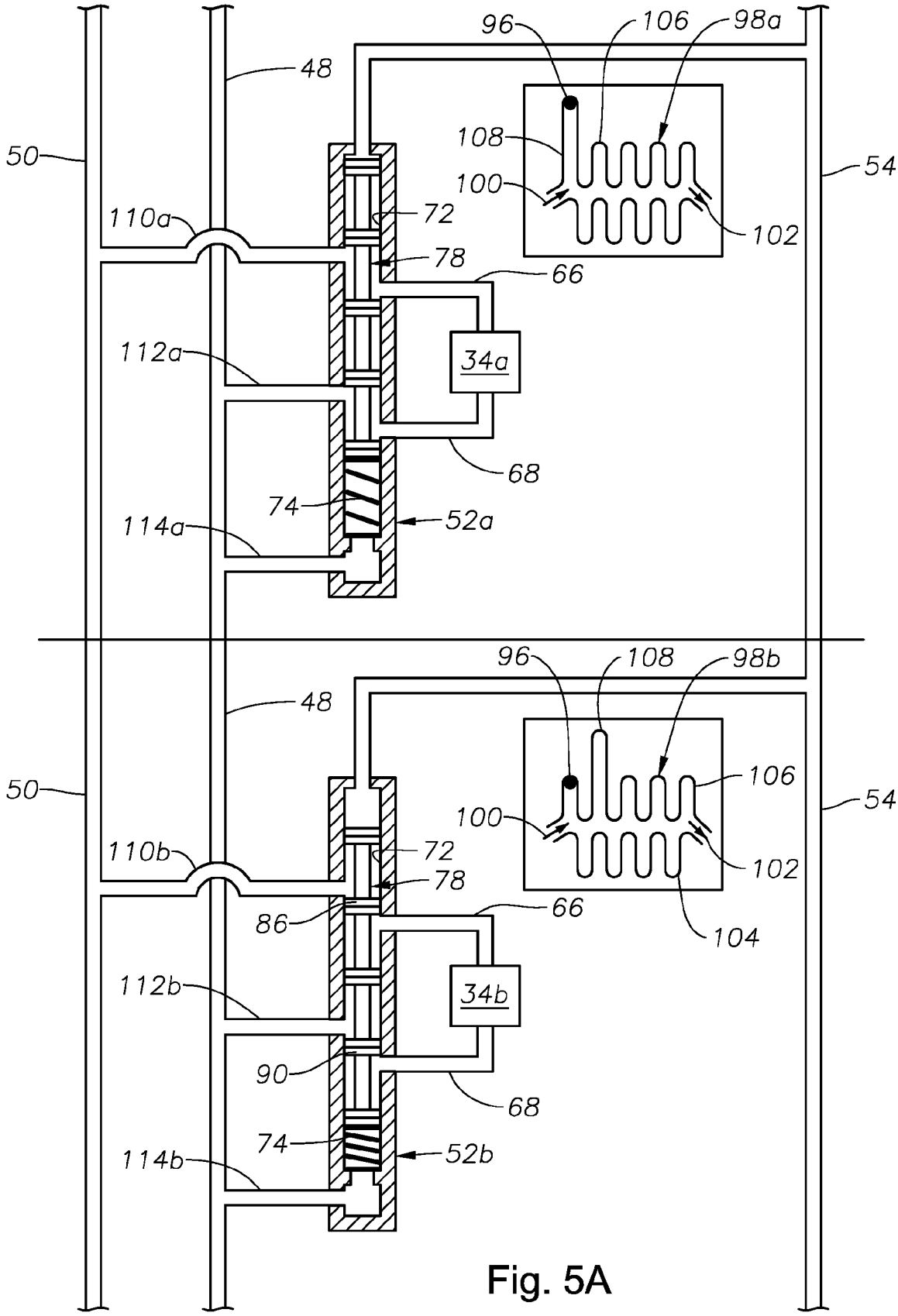
FIGS. 5A-5C are a schematic view of an exemplary control system for the multiple sliding sleeve valve devices shown in FIG. 1 in a first configuration.
Figure 5B:
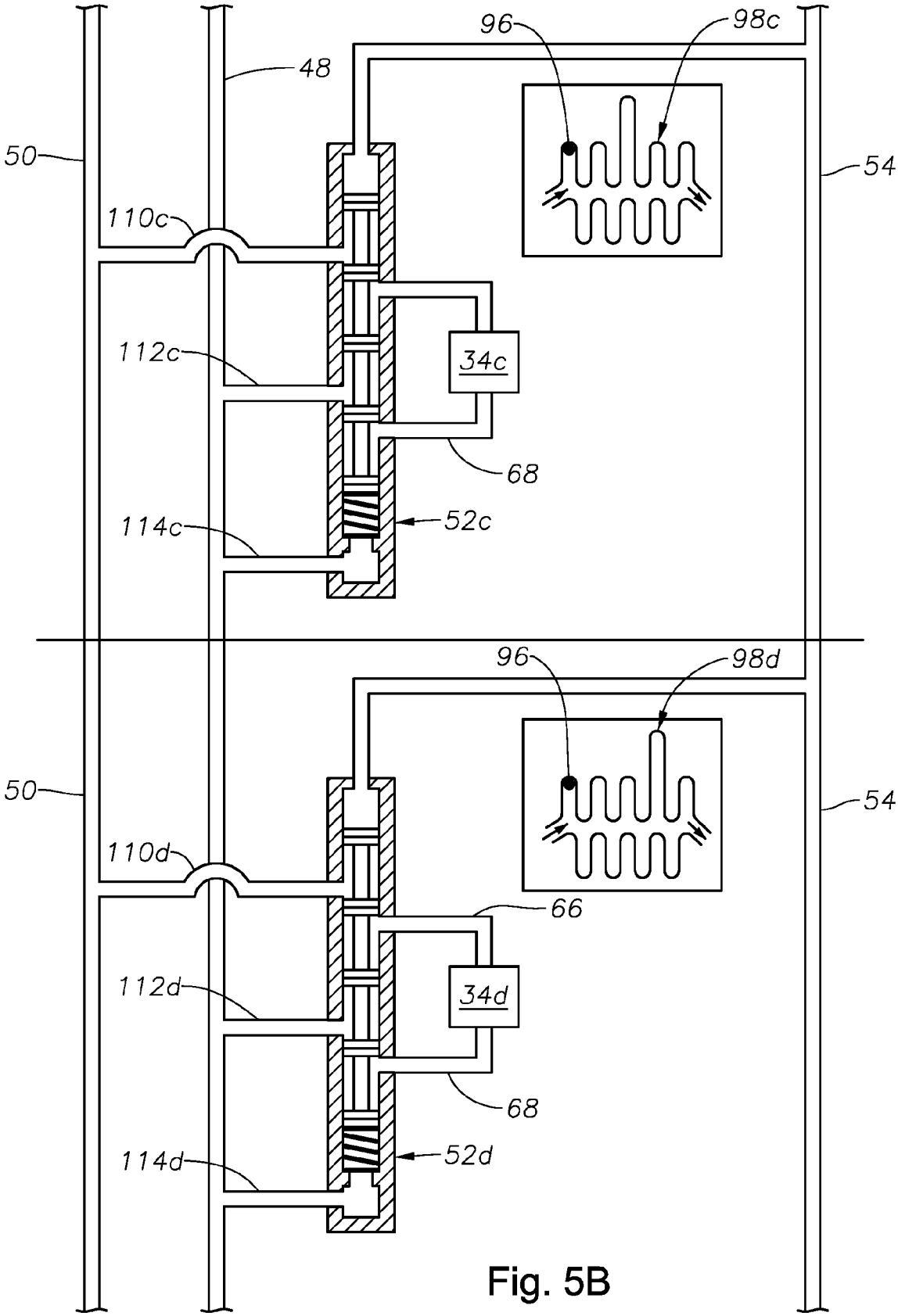
Figure 5C:
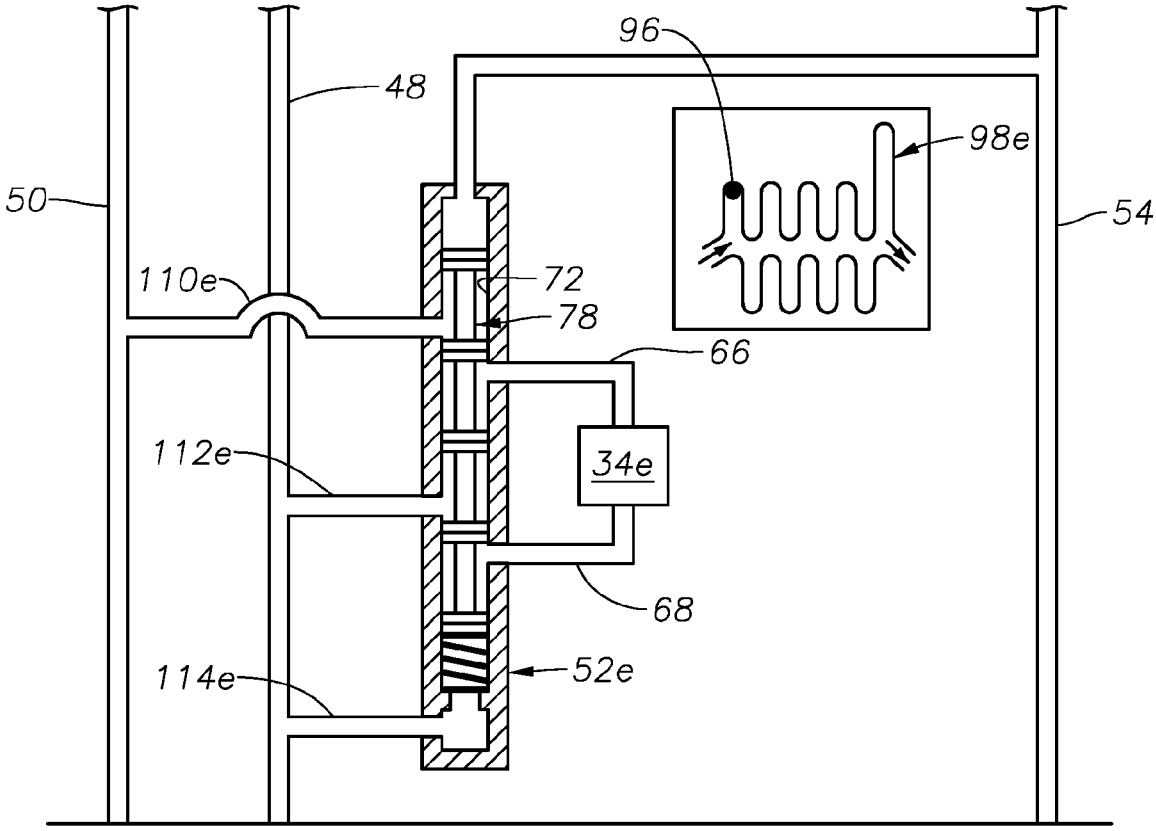

Each of the sleeve controllers 52*a*, 52*b*, 52*c*, 52*d* and 52*e* has a unique lug path, which is best shown in FIGS. 5A-5C. FIGS. 5A-5C depict the inscribed lug paths 98*a*, 98*b*, 98*c*, 98*d* and 98*e* for each of the sleeve controllers 52*a*, 52*b*, 52*c*, 52*d* and 52*e*. For clarity, the lug paths are depicted in an "unrolled" fashion beside the corresponding sleeve controller 52*a*, 52*b*, 52*c*, 52*d* or 52*e*. As is known in the art, a lug member 96 can be moved along each lug path by axial movement of the piston member 78 within the chamber 72. The lug member 96 and lug path 98 thereby provide an indexing system for control of the axial position of the piston member 78 within the surrounding sleeve controller housing 70, as will be described. Operation of complimentary lug members and lug paths is often referred to in the industry as a "J-slot" device. Such devices are described, for example, in U.S. Pat. No. 6,948,561 issued to Myron and entitled "Indexing Apparatus." U.S. Pat. No. 6,948,561 is owned by the assignee of the present invention and is herein incorporated by reference in its entirety.

In operation, the lug member 96 is moved along a lug path 98 as the piston member 78 is shifted upwardly and downwardly within the chamber 72. The piston member 78 rotates within the chamber 72 to accommodate movement of the lug member from the path entrance 100 toward the path exit 102. It is noted that, because the interior surface of the chamber 72 is curved to form a closed cylinder, the exit 102 will interconnect with the path entrance 100 to permit As can be seen in FIGS. 5A-5C, the lug paths 98*a*, 98*b*, 98*c*, 98*d* and 98*e* include a series of upwardly and downwardly directed path legs. In the depicted embodiment, the downwardly directed legs 104 all are essentially the same length. There are also short upwardly directed legs 106 and longer upwardly directed legs 108. When the lug member 96 is within the path 98, it moves from an upwardly directed leg (106 or 108) to a downwardly directed leg 104 and back again, as indicated by the directional arrow path 110 in FIG. 3. It is noted that, as the lugs 96 enter the path entrance 100, they travel to a first lug position, which is shown by the location of lug 96 in each of the lug paths 98*a*, 98*b*, 98*c*, 98*d* and 98*e* in FIG. 5. In order to shift the lug 96 into this first position, hydraulic fluid pressure within the cycling line 54 is reduced. This permits the spring 74 to urge the piston member 78 upwardly until the lug 96 enters the first available upwardly directed leg 106 or 108. In the instance of the uppermost sleeve controller 52*a*, the lug member 96 is moved upwardly into a longer upwardly directed leg 108. In this position, the piston member 78 is positioned so that fluid flow path 110*a* from line 50 is in fluid communication with upper fluid conduit 66 and flow path 112*a* from line 48 is in fluid communication with lower fluid conduit 68. It is noted that flow path 114*a* extends from the hydraulic control line 48 and into the chamber 72 below the spring 74 and piston member 78. As a result, pressurization of the cycling line 54 will move the piston member downwardly within the chamber 72 while the compression spring 74 and pressurization of the control line 48 (via the flow path 114*a*) will move the piston upwardly within the chamber 72.

FIGS. 5A-5C depict the five PCD sleeve devices 34, here designated 34*a*, 34*b*, 34*c*, 34*d*, and 34*e*, in association with the control system provided by the sleeve controllers 52*a*, 52*b*, 52*c*, 52*d* and 52*e*. Further, in FIGS. 5A-5C, the sleeve controllers 52*a* . . . 52*e* are all in a first condition wherein the legs 96 of the respective sleeve controller pistons 78 are at their first lug position within their respective lug path 98*a*, 98*b*, 98*c*, 98*d* and 98*e*. In this first position, some of the sleeve devices 34 can be operated to shift the sleeve 60 within while others are prevented from such operation. Because the control lines 48 and 50 are in fluid communication with the flow paths 66 and 68 via sleeve controller 52*a*, the uppermost pressure controlled device 34*a* can be actuated by selective flow of fluid into and out of the device via lines 66, 68 to shift the sleeve member 60 therewithin.

In contrast to the uppermost pressure controlled sleeve device 34*a*, the second sleeve device 34*b* cannot be actuated to move its sleeve 60 between open and closed positions. The lug member 96 in lug path 98*b* is located in a short upwardly extending leg 106. As a result, the piston member 78 in the sleeve controller 52 is located such that radially enlarged portion 86 of the piston member 78 is disposed between the fluid path 110*b* and the upper fluid conduit 66, blocking fluid communication therebetween. The radially enlarged portion 90 of the piston member 78 is disposed between the fluid path 112*b* and the lower fluid conduit 68, also blocking fluid communication between the common control line 48 and sleeve device 34*b*.

It can be seen from FIGS. 5B and 5C that the sleeve controllers 52*c*, 52*d* and 52*e* are in the same configuration as the sleeve controller 52*b*. As a result, the sleeve devices 34*c*, 34*d* and 34*e* are also unable to be actuated by hydraulic fluid variation of the control lines 48, 50. The sleeve devices 34*b*, 34*c*, 34*d* and 34*e* can be considered to be "locked out" from operation. Therefore, in the first control system position illustrated in FIGS. 5A-5C, the uppermost PCD sleeve device 34*a* is the only sleeve device that can be operated via the control lines 48, 50.

Figure 6A:
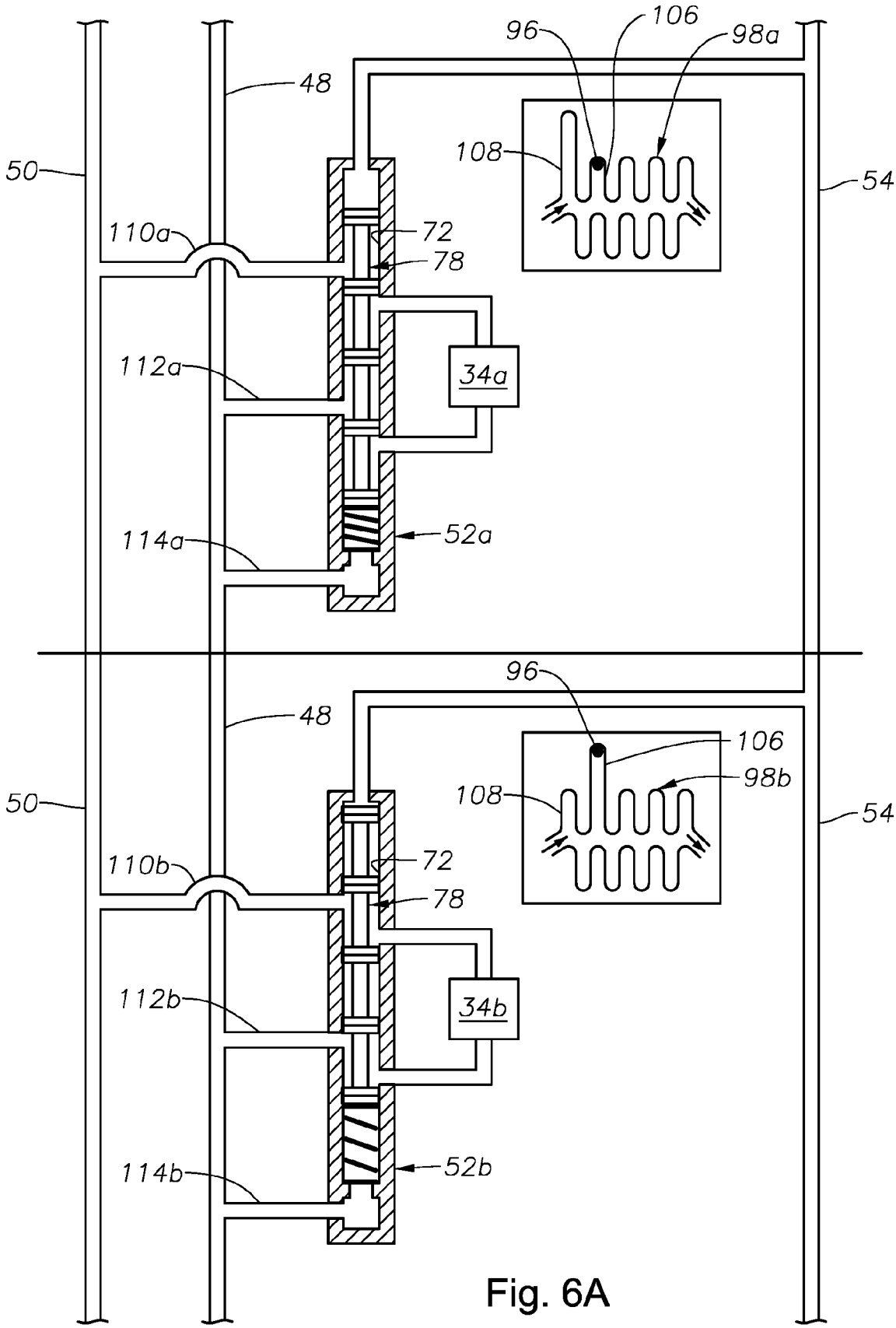
FIGS. 6A-6C are a schematic view of the exemplary control system of FIGS. 5A-5C now in a second configuration.
Figure 6B:
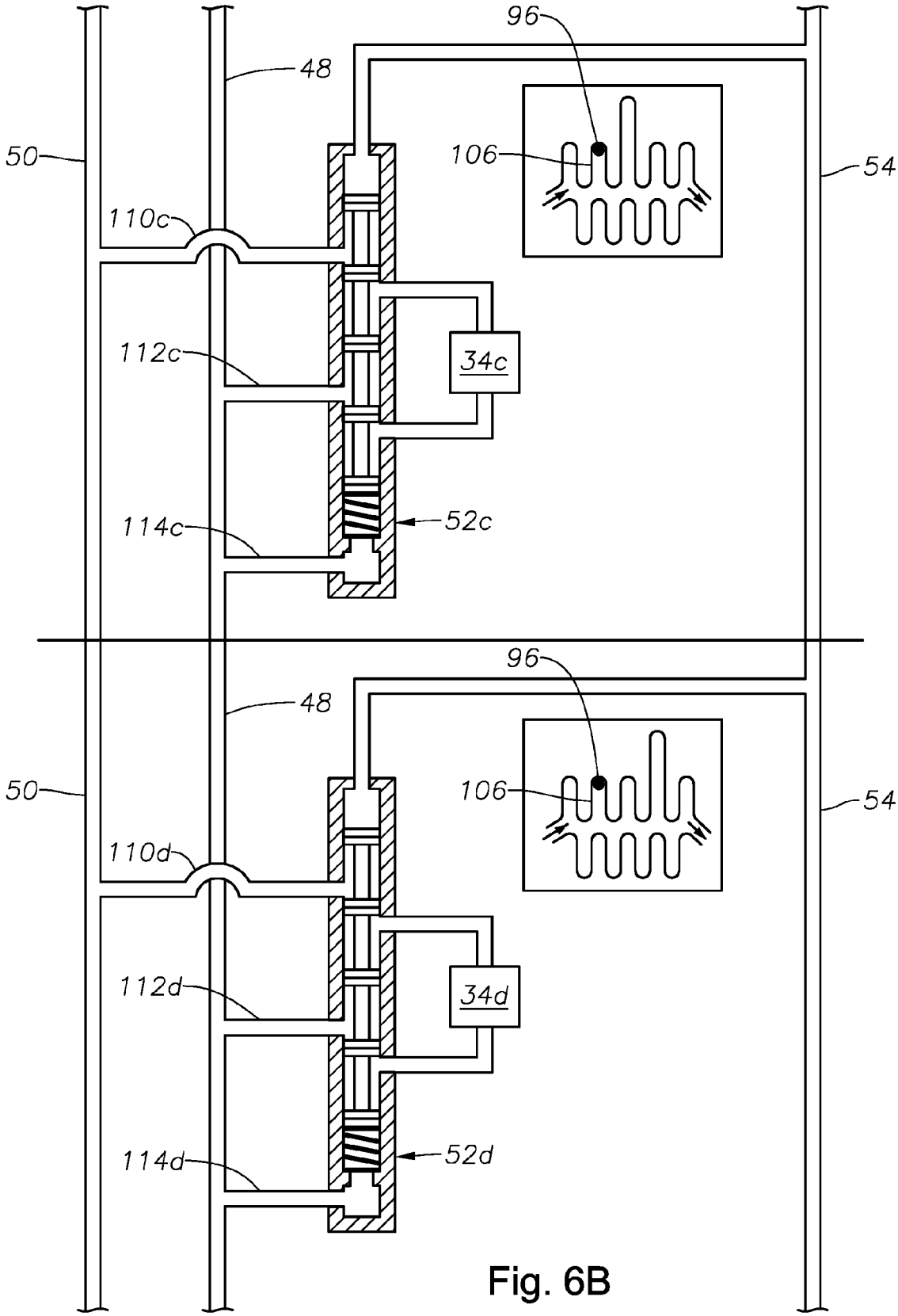
Figure 6C:
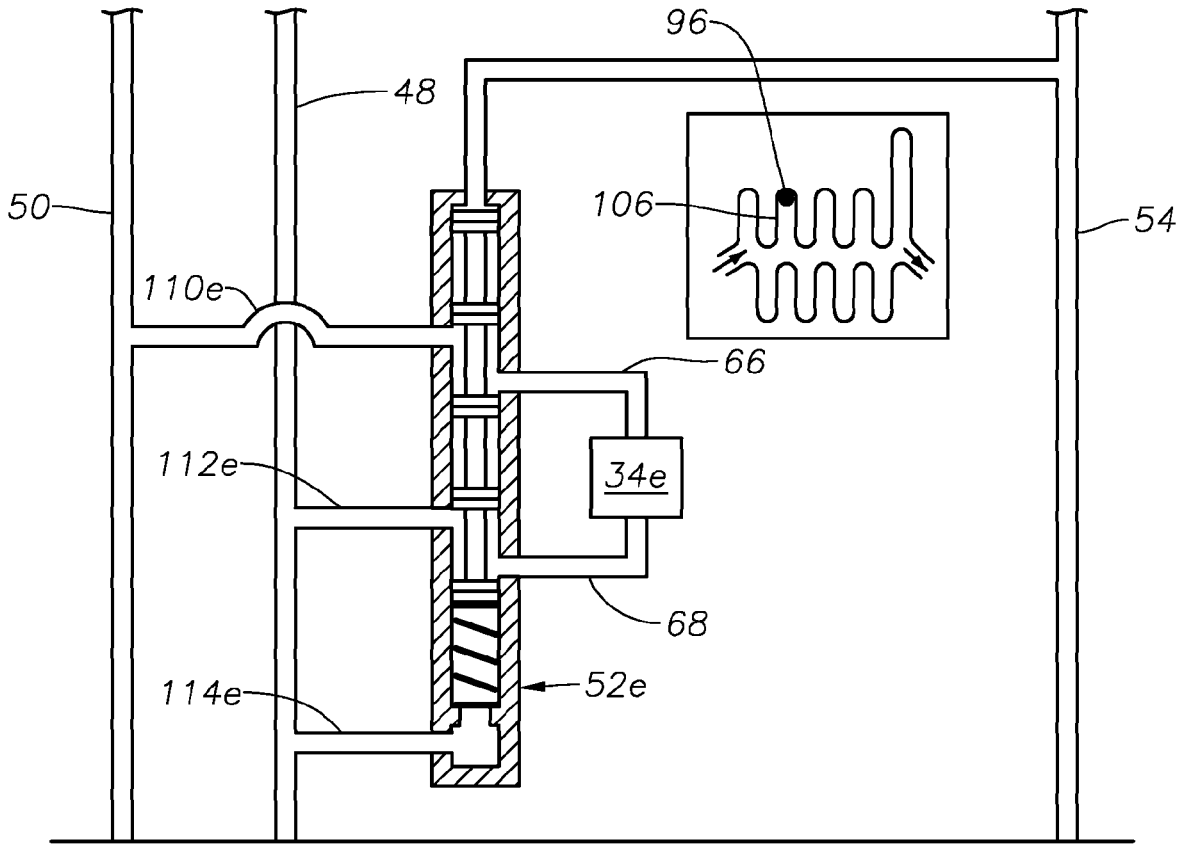

FIGS. 6A, 6B and 6C depict a second operational position for the control system wherein the lugs 96 of each sleeve controller 52*a*, 52*b*, 52*c*, 52*d* and 52*e* have been moved from the first control system position shown in FIGS. 5A-5C to a second position. The lugs 96 are moved to their second positions by pressurizing the common cycling line 54 and then depressurizing it a single time. Pressurizing the cycling line 54 will cause the lug member 96 of each sleeve controller 52 to move out of the first upwardly directed leg 106 or 108 and downwardly into the first downwardly-directed leg 102. Upon depressurizing the common cycling line 54, the springs 74 will urge the piston members 78 upwardly until the lugs 96 enter the second available upwardly-directed leg 106 or 108. This pressurization and depressurization of the cycling line 54 can be used to sequentially step the sleeve controllers 52*a*, 52*b*, 52*c*, 52*d* and 52*e* through further operational positions. As can be seen in FIGS. 6A-6C, the lugs 96 of each sleeve controller 52 are now located within a second upwardly-directed leg 106 or 108 within their respective lug paths 98*a*, 98*b*, 98*c*, 98*d* and 98*e*. The lug 96 of the second sleeve controller 52*b* is disposed within an extended upwardly directed leg 108 while the lugs 96 of the remaining sleeve controllers 52*a*, 52*c*, 52*d* and 52*e* are all disposed in short upwardly directed legs 106. As a result, the sleeve controller 52*b* is configured to permit the PCD sleeve device 34*b* to be actuated by the control lines 48, 50 while the remaining sleeve controllers 52*a*, 52*c*, 52*d* and 52*e* are configured to lock out operation of their respective PCD sleeve devices 34*a*, 34*c*, 34*d* and 34*e*.

Figure 7A:
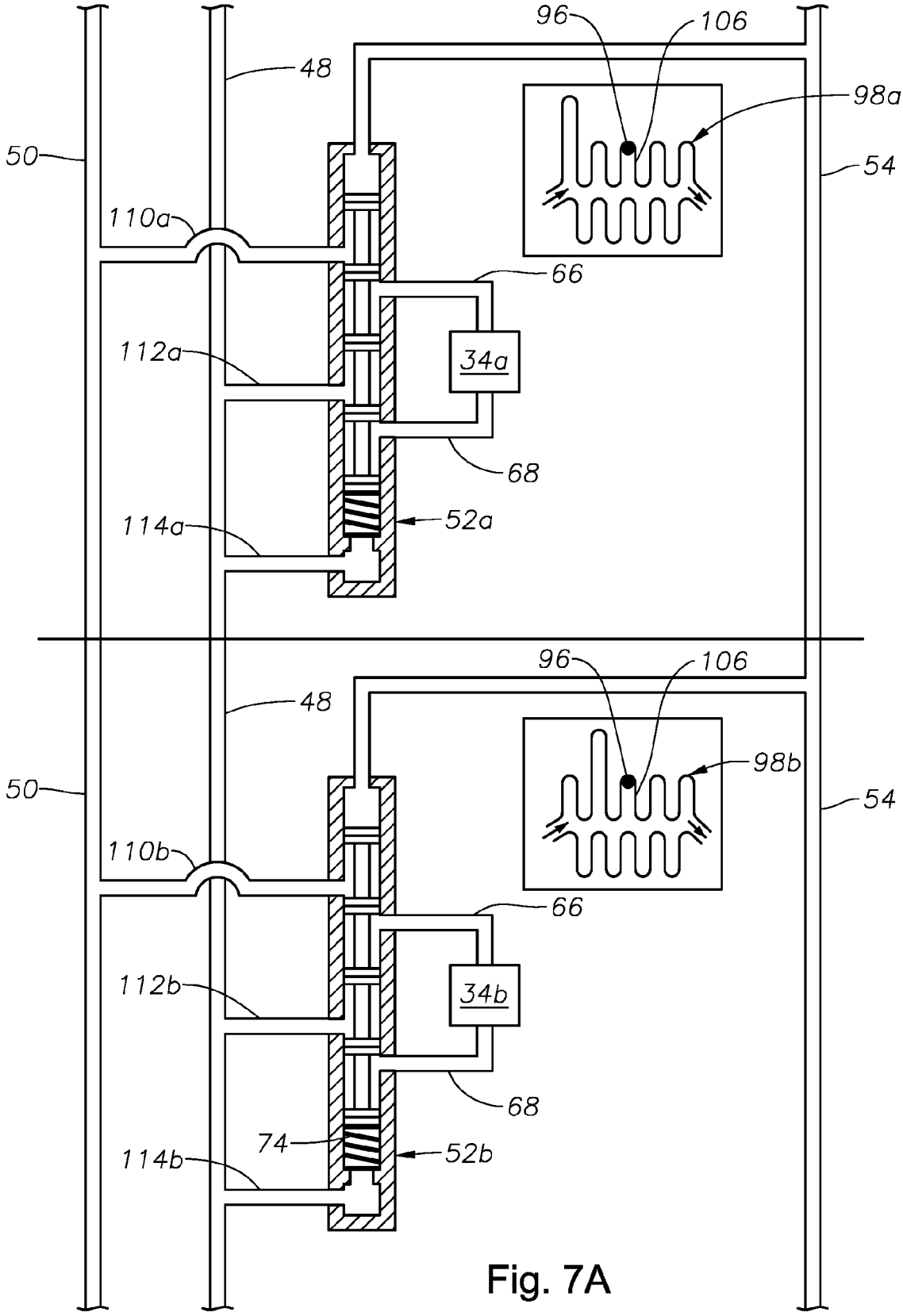
FIGS. 7A-7C are a schematic view of the exemplary control system of FIGS. 5A-5C and 6A-6C now in a third configuration.
Figure 7B:
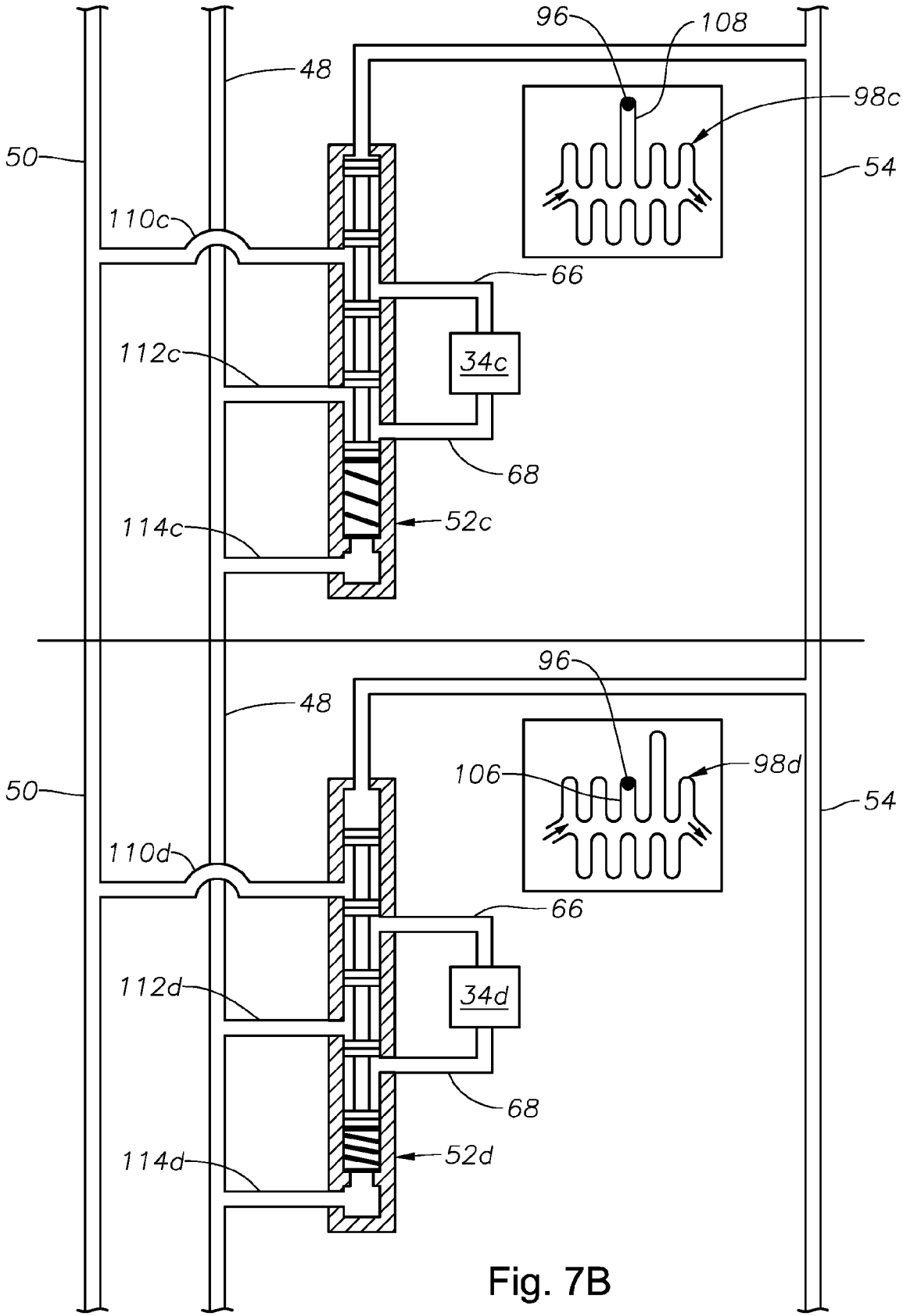
Figure 7C:
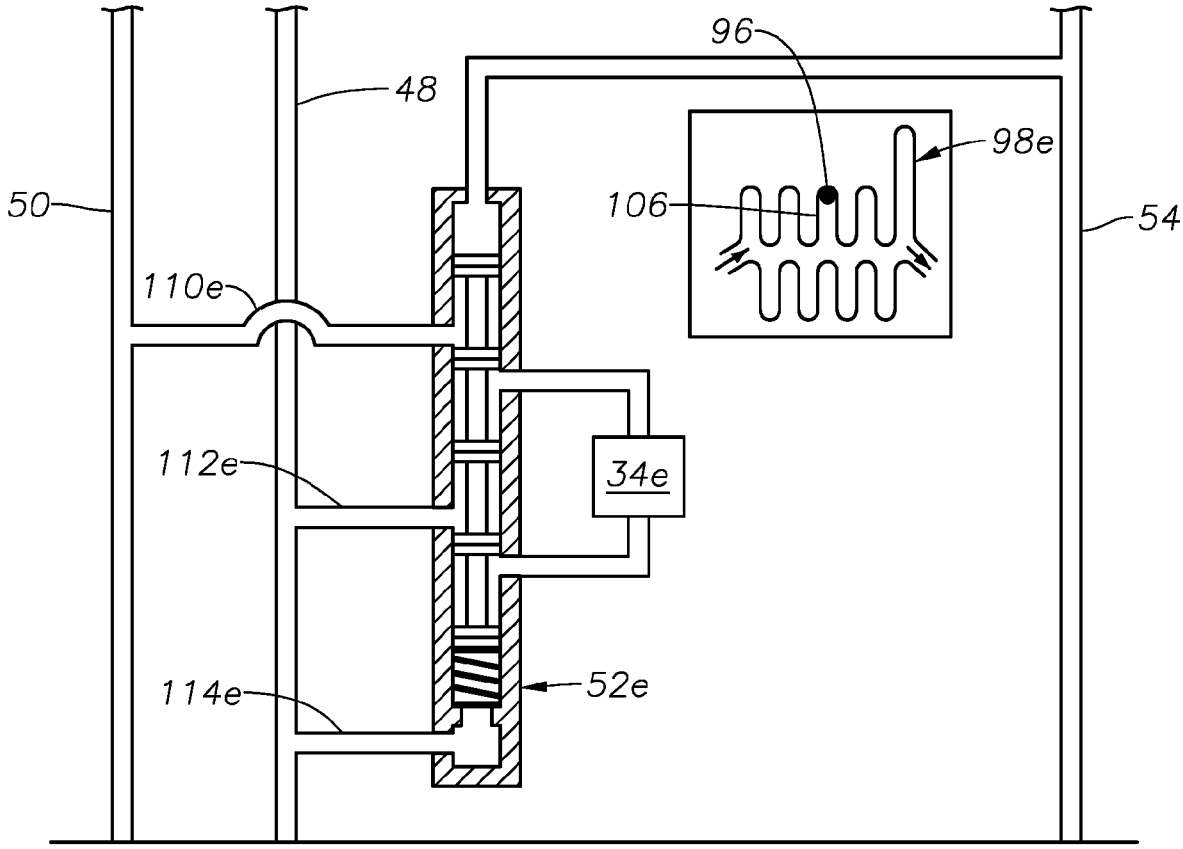

FIGS. 7A-7C depict the exemplary control system of the present invention in a third configuration. In this configuration, the lug members 96 of each sleeve controller 52*a*, 52*b*, 52*c*, 52*d* and 52*e* are located in a third upwardly-directed leg 106 or 108 in their respective lug path 98*a*, 98*b*, 98*c*, 98*d* or 98*e*. In this configuration, only the lug member 96 of the third sleeve controller 52*c* is disposed within an extended upwardly-directed leg 108. The lugs 96 of the remaining sleeve controllers 52*a*, 52*b*, 52*d* and 52*e* are located in shorter upwardly directed legs 106. In this configuration, the PCD sleeve device 34*c* may be actuated while the remaining PCD sleeve devices 34*a*, 34*b*, 34*d* and 34*e* are locked out from actuation.

This manner of selective isolation of individual PCD devices 34 for operation may be continued by pressurizing and depressurizing the common cycling line 54. This will move the lugs 96 of the sleeve controllers 52*a*, 52*b*, 52*c*, 52*d* and 52*e* into subsequent upwardly extending legs 106 or 18 so that the remaining PCD sleeve devices 34*d* and 34*e* may be selectively isolated for actuation by the control lines 48, 50. In the configuration wherein the lugs 96 are located in the fourth available upwardly directed legs 106, 108, the PCD sleeve device 34*d* will be isolated for actuation by the control lines 48, 50. In the configuration wherein the lugs 96 are located in the fifth available upwardly-directed legs 106 or 108, the PCD sleeve device 34*e* will be isolated for actuation by the control lines 48, 50.

Figure 8:
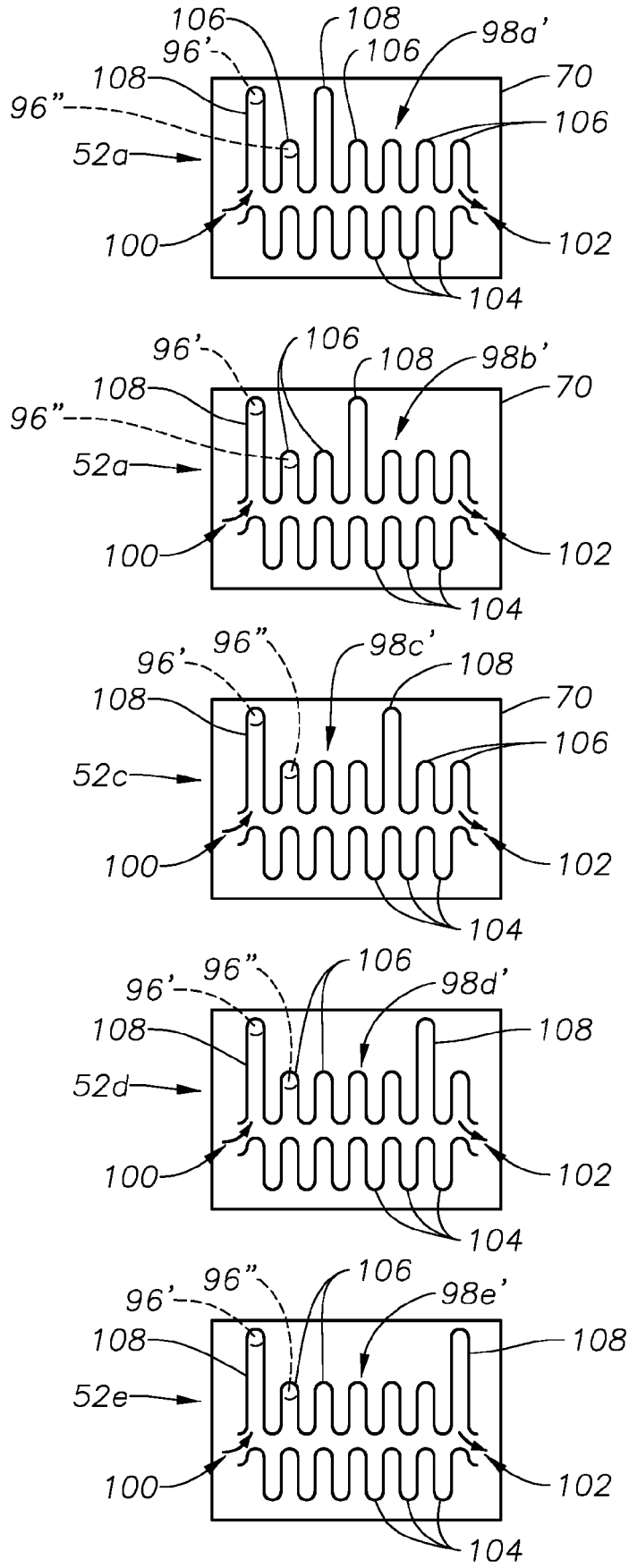
FIG. 8 depicts alternative exemplary lug paths used within separate sleeve controllers.

FIG. 8 illustrates an alternative set of lug paths 98*a*', 98*b*' 98*c*', 98*d*' and 98*e*' having a "common open" position and a "common closed" position. The lug position 96' is shown wherein each of the lugs 96' are disposed within an extended length upwardly-directed leg 108. This "common open" configuration permits all of the PCD sleeve devices 34*a*, 34*b*, 34*c*, 34*d* and 34*e* to be simultaneously actuated via the common control lines 48, 50. A "common closed" lug position 96" is also shown wherein all of the corresponding PCD sleeve devices 34*a*, 34*b*, 34*c*, 34*d* and 34*e* are locked out from actuation by variations in fluid pressure within the control lines 48, 50.

It can be seen that the sleeve controllers 52*a*, 52*b*, 52*c*, 52*d* and 52*e* and cycling line 54 collectively provide an operating system for selectively controlling the plurality of PCD devices 34*a*, 34*b*, 34*c*, 34*d*, and 34*e* using common hydraulic control lines 48, 50. In operation, each of the PCD sleeve devices 34*a*, 34*b*, 34*c*, 34*d*, and 34*e* may be selectively operated by cycling the sleeve controllers 52*a*, 52*b*, 52*c*, 52*d* and 52*e* to a position wherein one of the sleeve devices 34 can be isolated for operation while the remaining sleeve devices 34 are locked out from operation by the control lines 48, 50. In addition, the control system of the present invention may be used to cause all of the PCD sleeve devices 34 to be operated simultaneously by moving the sleeve controllers 52 into a "common open" configuration. Also, all of the PCD sleeve devices 34 may be locked out from actuation by moving the sleeve controllers 52 into a "common closed" configuration.

Those of skill in the art will likewise recognize that the lug paths 98 for the sleeve controllers 52 may be customized to have positions wherein more than one but fewer than all of the PCD sleeve devices 34 may be actuated by the common control lines 48, 50. For example, in a particular setting, the lug paths 98*a* and 98*b* would have extended length upwardly-directed legs 108 while the remaining lug paths 98*c*, 98*d* and 98*e* would have short upwardly directed legs 106. When the lug members 96 are located in these positions, PCD devices 34*a*, 34*b* could be operated via the control lines 48, 50 while the remaining PCD devices 34*c*, 34*d* and 34*e* are locked out from operation.

The described embodiment depicts five PCD sleeve devices 34. However, there can be more or fewer than five PCD devices, depending upon the needs of the particular wellbore. In addition, while the particular PCD devices that are described for use with the described control system are sliding sleeve devices, they may also be other hydraulically controlled devices, such as safety valves or chemical injection valves.

Those of skill in the art will recognize that numerous modifications and changes may be made to the exemplary designs and embodiments described herein and that the invention is limited only by the claims that follow and any equivalents thereof.

What is claimed is:

1. A control system for controlling first and second hydraulic pressure-controlled devices comprising:

a common hydraulic control line in operable association with the first and second pressure controlled device;

a first sleeve controller associated with the first pressure controlled device and the common control line to provide selective control of the first pressure controlled device via the control line;

a second sleeve controller associated with the second pressure controlled device and the common control line to provide selective control of the second pressure controlled device via the control line;

the first and second sleeve controllers each comprising:

a housing which defines a piston chamber;

a piston member moveably disposed within the housing between a first position wherein the piston member does not block fluid flow between the control line and the associated pressure-controlled device, and a second position wherein the piston member does block fluid flow between the control line and the associated pressure-controlled device;

a J-slot indexing mechanism that controls the position of the piston within the chamber; and the first and second sleeve controllers each being operable between a first condition, wherein control of the associated pressure-controlled device is permitted, and a second condition, wherein control of the associated pressure-controlled device is permitted.

2. The control system of claim 1 further comprising a hydraulic cycling line operably connected with each of the sleeve controllers to cause the piston member to be moved between the first position and the second position.

3. The control system of claim 1 further comprising a compression spring within the chamber of each to bias the piston member within the chamber.

4. The control system of claim 1 wherein the piston member of each sleeve controller comprises:

a central shaft; and a plurality of radially-enlarged piston portions affixed to the central shaft, each of the piston portions forming a fluid seal against the housing.

5. The control system of claim 1 wherein the first and second pressure-controlled devices comprise sliding sleeve valves.

6. The control system of claim 1 wherein the first and second pressure-controlled devices comprise safety valves.

7. The control system of claim 1 wherein the first and second pressure-controlled devices comprise chemical injection valves.

8. A flow control system for use within a production tubing string within a wellbore, the system comprising:

a first hydraulic pressure-controlled device for governing flow between the wellbore and the tubing string;

a second hydraulic pressure-controlled device for governing flow between the wellbore and the tubing string;

a common hydraulic control line in operable association with the first and second pressure-controlled devices;

a first sleeve controller associated with the first pressure-controlled device and the common control line to provide selective control of the first pressure-controlled device via the control line;

a second sleeve controller associated with the second pressure-controlled device and the common control line to provide selective control of the second pressure-controlled device via the control line;

the first and second sleeve controllers each comprising:

a housing which defines a piston chamber;

a piston member moveably disposed within the housing between a first position wherein the piston member does not block fluid flow between the control line and the associated pressure-controlled device, and a second position wherein the piston member does block fluid flow between the control line and the associated pressure-controlled device; and a J-slot indexing mechanism that controls the position of the piston within the chamber.

9. The flow control system of claim 8 further comprising a hydraulic cycling line operably connected with each of the sleeve controllers to cause the piston member to be moved between the first position and the second position.

10. The flow control system of claim 8 further comprising a compression spring within the chamber of each to bias the piston member within the chamber.

11. The control system of claim 8 wherein the piston member of each sleeve controller comprises:

a central shaft; and a plurality of radially-enlarged piston portions affixed to the central shaft, each of the piston portions forming a fluid seal against the housing.

12. The control system of claim 8 wherein the J-slot indexing mechanisms include a common open position wherein both the first and second pressure-controlled devices can be controlled using the common control line.

13. The control system of claim 8 wherein the J-slot indexing mechanisms include a common closed position wherein both the first and second pressure-controlled devices are locked out from control by the common control line.

14. The control system of claim 8 wherein the J-slot indexing mechanisms include a position wherein the first pressure-controlled device can be controlled using the common control line and the second pressure-controlled device is locked out from control by the common control line.

15. A flow control system for use within a production tubing string within a wellbore, the system comprising:

a first hydraulic pressure-controlled device for governing flow between the wellbore and the tubing string;

a second hydraulic pressure-controlled device for governing flow between the wellbore and the tubing string;

a common hydraulic control line in operable association with the first and second pressure-controlled device;

a first sleeve controller associated with the first pressure-controlled device and the common control line to provide selective control of the first pressure-controlled device via the control line;

a second sleeve controller associated with the second pressure-controlled device and the common control line to provide selective control of the second pressure-controlled device via the control line;

wherein the first and second sleeve controllers each comprise:

a housing which defines a piston chamber;

a piston member moveably disposed within the housing between a first position wherein the piston member does not block fluid flow between the control line and the associated pressure-controlled device, and a second position wherein the piston member does block fluid flow between the control line and the associated pressure-controlled device; and a J-slot indexing mechanism that controls the position of the piston within the chamber.

16. The flow control system of claim 15 further comprising a hydraulic cycling line operably connected with each of the sleeve controllers to cause the piston member to be moved between the first position and the second position.

17. The control system of claim 15 wherein the piston member of each sleeve controller comprises:

a central shaft; and a plurality of radially-enlarged piston portions affixed to the central shaft, each of the piston portions forming a fluid seal against the housing.

18. The control system of claim 15 wherein the J-slot indexing mechanisms include a position wherein the first pressure-controlled device can be controlled using the common control line and the second pressure-controlled device is locked out from control by the common control line.

* * * * *

UNITED STATES PATENT AND TRADEMARK OFFICE

CERTIFICATE OF CORRECTION

PATENT NO. : 7,730,953 B2
APPLICATION NO. : 12/039844
DATED : June 8, 2010
INVENTOR(S) : Dario Casciaro It is certified that error appears in the above-identified patent and that said Letters Patent is hereby corrected as shown below:

In col. 7, line 9, the phrase "is permitted" should be -- is not permitted --.

Signed and Sealed this

Thirteenth Day of July, 2010

David J. Kappos

David J. Kappos
*Director of the United States Patent and Trademark Office*